US005148079A

United States Patent [19]

Kado et al.

[11] Patent Number: 5,148,079

[45] Date of Patent: Sep. 15, 1992

[54] PLANAR TYPE COLD CATHODE WITH SHARP TIP ENDS AND MANUFACTURING METHOD THEREFOR

[75] Inventors: Hiroyuki Kado; Masanori Watanabe, both of Katano, Japan

[73] Assignee: Matsushita Electric Industrial Co., Ltd., Osaka, Japan

[21] Appl. No.: 662,574

[22] Filed: Mar. 1, 1991

[30] Foreign Application Priority Data

Mar. 1, 1990 [JP] Japan ..... 2-049770

[51] Int. Cl.[5] ..... H01J 1/02; H01J 1/30

[52] U.S. Cl. ..... 313/309; 313/336; 313/351

[58] Field of Search ..... 313/309, 336, 351

[56] References Cited

U.S. PATENT DOCUMENTS 4,827,177 5/1989 Lee et al. ..... 313/336
4,904,895 2/1990 Tsukamoto et al. ..... 313/351

FOREIGN PATENT DOCUMENTS 0290026 11/1988 European Pat. Off. .
0406886 1/1991 European Pat. Off. .
63-274047 11/1988 Japan .
0033833 2/1989 Japan ..... 313/336

OTHER PUBLICATIONS

"Physical Properties of Thin-Film Field Emission Cathodes with Molybdenum Cones" by G. A. Spindt, et al., Journal of Applied Physics, vol. 47, No. 12, Jul., 1976.

*Primary Examiner*—Donald J. Yusko
*Assistant Examiner*—N. D. Patel
*Attorney, Agent, or Firm*—Wenderoth, Lind & Ponack

[57] ABSTRACT

A planar type cold cathode for generating electron field emission which has a planar cold cathode having triangular convex portions and an anode confronting the triangular convex portions wherein each convex portion has a sharp tip end having a radius of curvature of 0.1 μm or less. Also, a manufacturing method therefor is disclosed. In this method, sharp tip ends of the cold cathode are formed by using a normal etching technique.

2 Claims, 3 Drawing Sheets

PLANAR TYPE COLD CATHODE WITH SHARP TIP ENDS AND MANUFACTURING METHOD THEREFOR

BACKGROUND OF THE INVENTION

1. Field of the Invention

The present invention generally relates to an electron source using a planar type cold cathode having tip end portions with a minute radius of curvature.

2. Description of Related Art

Conventionally, there have been proposed a large number of cold cathodes of the thin-film field emission type. Among these cathodes, a planar type cold cathode as shown in FIG. 6.(see, for example, Japanese Patent Laid-open Publication No. SHO 63-274047/1988) is said to be capable of generating electron emission at an applied voltage of 80 V or more. As shown in FIG. 6, this cold cathode is constituted by a cold cathode 24 arranged to confront an anode 25 on the surface of a substrate 23 of electrically insulating material. On the end face of the cold cathode confronting the anode, there are formed a large number of triangular convex portions each having a tip end portion with a minute radius of curvature by a microfabrication technique of submicron order. The distance between the tip end portions of the convex portions provided in said cold cathode and the anode is 0.1 μm. When a voltage of 100 V or more is applied between said cold cathode thus constituted and the anode, because of the small radius of curvature of the tip end portion of each cold cathode, there is developed a strong electric field of $2\times10^7$ V/cm at the tip end of each convex portion, resulting in field emission of electrons at the tip end portions.

Although said planar type cold cathode has an advantage as described above, it is necessary to make the radius of curvature at the tip end portion of the convex portions of the cold cathode as small as possible and to space the electrodes at a distance of submicron order. At present, however, according to the microfabrication method using a conventional photoetching technique, about, 0.7 μm is the limit. Therefore, in order to perform a still smaller microfabrication, it is necessary to use a maskless etching technique such as FIB. According to this technique, however, it is difficult to form a cold cathode having a large area, and furthermore, this technique is not suitable for putting into practical use from the cost view-point in the manufacturing process.

SUMMARY OF THE INVENTION

One object of the present invention is to provide a planar type cold cathode with sharp tip ends which is capable of generating an electron beam under a relatively low voltage.

Another object of the present invention is to provide a method for manufacturing planar type cold cathodes having sharp tip end portions with a minute radius of curvature equal to or less than 0.1 μm easily.

A further object of the present invention is to provide a method for manufacturing planar type cold cathodes having sharp tip end portions by using an isotropic etching technique.

In order to achieve these objects, according to the present invention, there is provided a planar type cold cathode for generating electron field emission which includes a planar cold cathode and an anode being formed on a substrate of electrically insulating material so as to confront each other, said cold cathode having substantially triangular convex portions projected toward said anode, being characterized in that at least one of two tip ends of each said convex portion defined by the principal planes of said cold cathode, respectively, has a radius of curvature of 0.1 μm or less, and that said one tip end of said each convex portion is formed so as to protrude toward said anode further than the other tip end thereof.

Since the planar type cold cathode according to the present invention has very sharp tip end portions with a radius of curvature less than 0.1 μm, it becomes possible to generate electron emission at an applied voltage lower than 100 V.

Further, according to the present invention, there is provided a manufacturing method for a cold cathode comprising the following steps; a step of forming a resist film on a film of electrically conductive material, said resist film being comprised of two portions separated from each other and having shapes similar to those of a cold cathode having substantially triangular convex portions and an anode to be formed, respectively; a step of etching said film of conductive material, by using an isotropic etching technique, and in which the side etching depth thereof becomes at least greater than the radius of curvature of the tip end of each triangular convex portion of said resist film;

According to the present invention, the formation of said resist film can be carried out using a conventional microfabrication technique since it is possible to form sharp tip ends of the cold cathode having a radius of curvature of 0.1 μm or less even if tip ends of triangular convex portions of the resist film are not formed so as to be as sharp as those using the conventional microfabrication technique.

When the isotropic etching technique is used, the cold cathode material thin film under the resist film is etched from the both sides of the resist film tip end portion. Therefore, when side etching is effected so that the etching depth becomes more than the radius of curvature at the resist film tip end portion, at least the tip end portion of the upper side of the cold cathode formed under the resist film is given a minute radius of curvature, and by continuing the etching further, the tip end portion of the lower side thereof also becomes very minute. Further with respect to the curvature in the film thickness direction of the cold cathode tip end portion, since the tip end portion of the lower side thereof is projected relative to that of the upper side, the radius of curvature of the projecting portion becomes very minute in this direction. Accordingly, even without using a microfabrication technique of submicron order such as FIB, a cold cathode having a radius of curvature of less than 0.1 μm can be formed with the conventional etching technique, resulting in a planar type cold cathode markedly advantageous in respect of the manufacturing cost. When a voltage is applied between a cathode formed in this manner and an anode provided so as to confront said cathode, even with an electrode distance of more than 1 μm, there is developed a strong electric field at each sharp tip end portion of said cold cathode, resulting in a planer type cold cathode which is operable at a low voltage.

BRIEF DESCRIPTION OF THE DRAWINGS

These and other objects and features of the present invention will become clear from the following description taken in conjunction with the accompanying drawings, in which.

DETAILED DESCRIPTION OF THE PREFERRED EMBODIMENT

Figure 1:
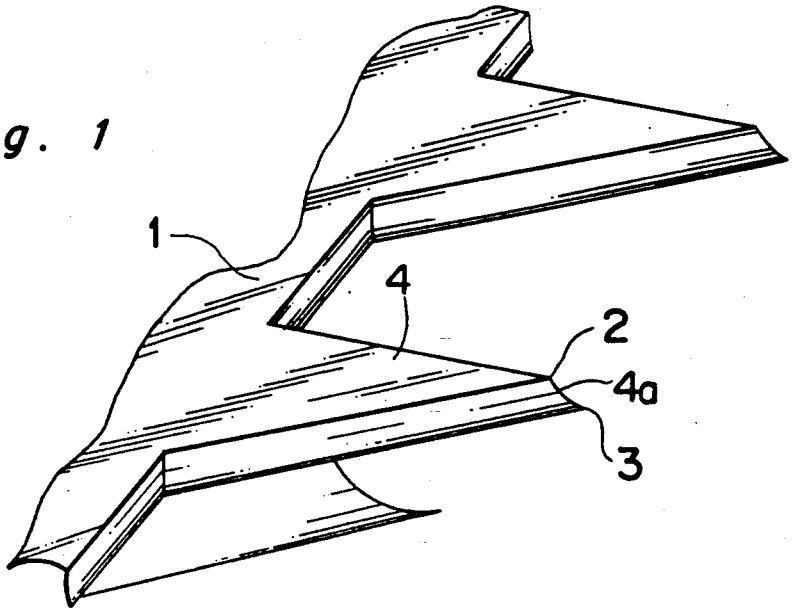
FIG. 1 is a perspective view of a planar type cold cathode according to a preferred embodiment of the present invention.

As shown on an enlarged scale, a planar cold cathode 1 has triangular convex portions 4 projected from one side edge thereof in a horizontal direction and each convex portion 4 has very sharp upper and lower, tip ends 2 and 3 defined by the upper and lower principal planar surfaces thereof and the ends of a tip edge 4a extending between the planar surfaces at the apex thereof. The upper tip end 2 is formed, according to the present invention, with a radius of curvature of 0.1 μm or less when measured on the upper principal plane. The lower tip end 3 is projects further than the upper one in the forward direction.

Figure 2:
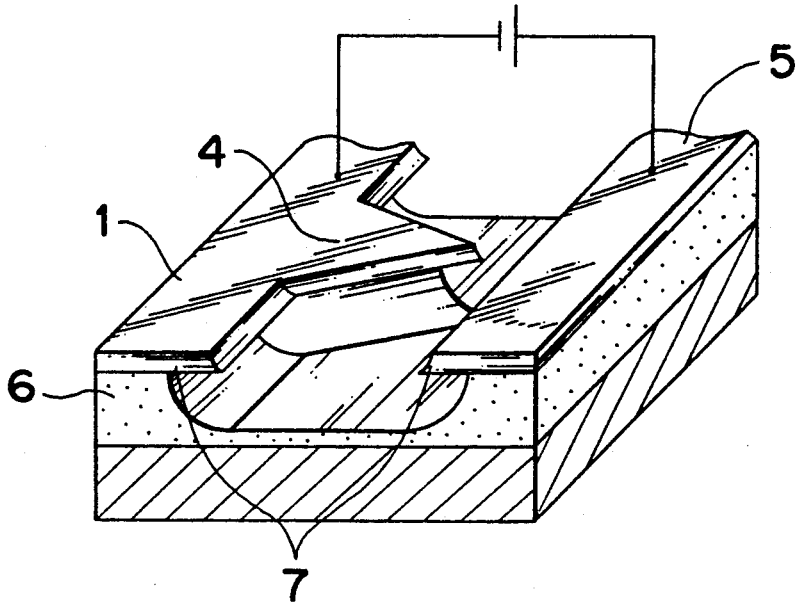
FIG. 2 is a perspective view of the cold cathode and the anode using the preferred embodiment of FIG. 1.

FIG. 2 is a partial perspective view showing a layout of said cold cathode 1 and an anode 5 arranged so as to confront said cathode 4. Both electrodes 1 and 5 are respectively formed on a substrate 6 of electrically insulating material and both edges thereof are formed to overhang a concave portion of the substrate 6. When a voltage is applied between these electrodes with the anode being given the higher potential, a strong electric field is generated at the tip end portion of each convex portion of the cold cathode 1 even with an electrode spacing of more than 1 μm, resulting in the field emission of electrons.

Figure 3:
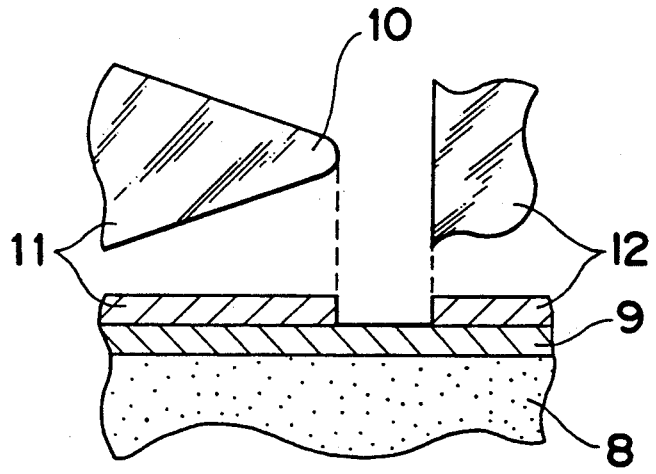
FIGS. 3 to 5 are an explanatory views for showing the manufacturing process for a planar type cold cathode in the preferred embodiment of FIG. 1.
Figure 4:
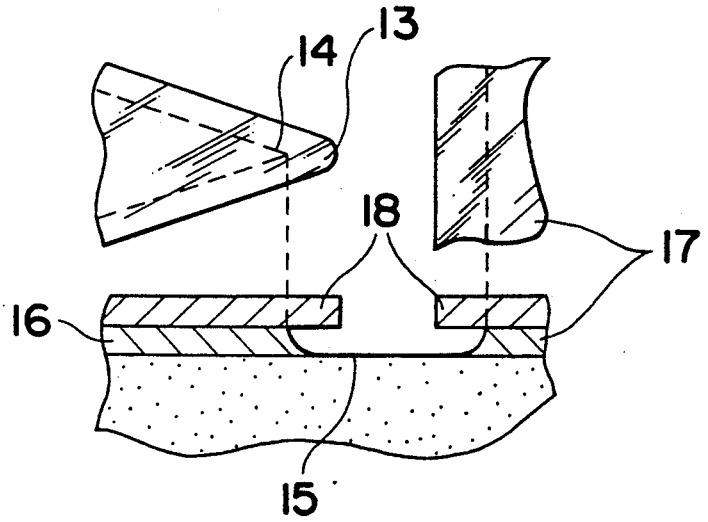
Figure 5:
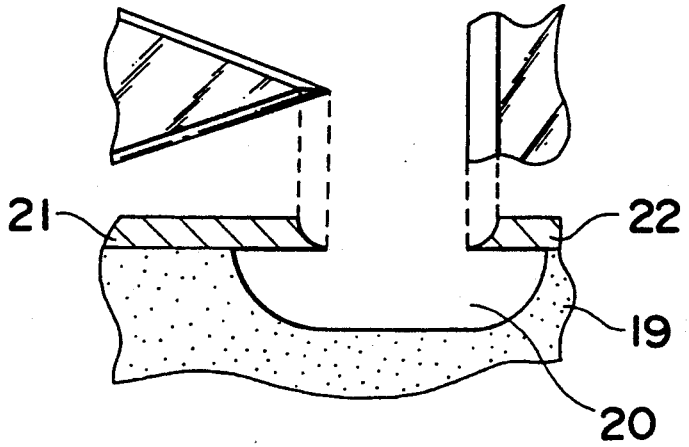
Figure 6:
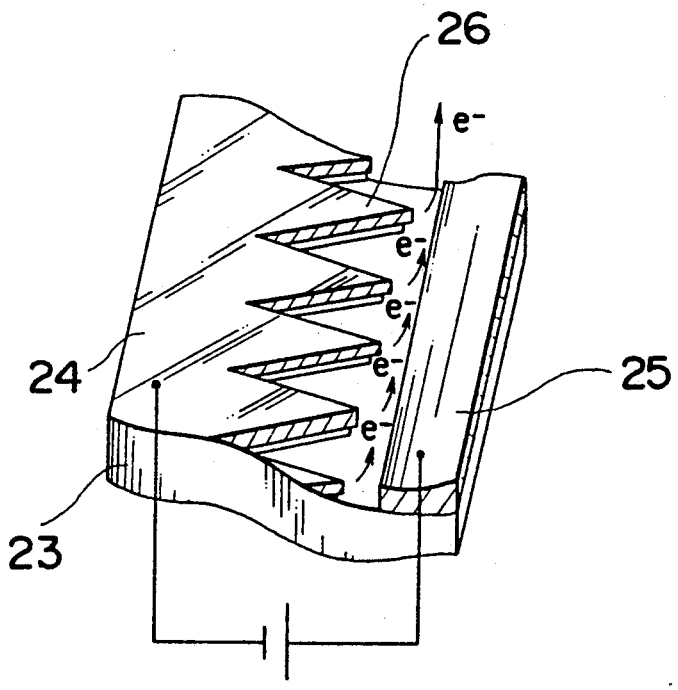
Fig. 6 PRIOR ART
FIG. 6 is a perspective view of a conventional planar type cold cathode.

FIGS. 3 through 5 show the manufacturing process for the planar cold cathode according to the present invention. After forming a $SiO_2$ film 8 of 1 μm thickness on the surface of a Si substrate as an electrically insulating material layer by thermal oxidization, a $WSi_2$ film 9 of 0.2 μm thickness for forming the electrodes 1 and 5 is deposited on the surface of said $SiO_2$ film 8. On the surface of this $WSi_2$ film 9, a resist film 11 having triangular convex portions 10 and a resist film 12 confronting said resist film 11 are formed by a photolithography technique (FIG. 3). The radius of curvature at the tip end portion of each convex portion 10 of the thus formed resist film 11 is about 0.5 μm. Subsequently, side etching is effected by immersing this substrate in nitrofluoric acid for four minutes thus to conduct isotropic etching, whereby a thin film cold cathode 16 with a tip end portion 14 having a minute radius of curvature is formed under the tip end portion 13 of the resist film 11 and having one projecting main surface 15, and a confronting anode 17 is formed simultaneously (FIG. 4). In the present preferred embodiment, a cold cathode having a tip end portion 15 of about 300 Å radius of curvature was formed. Subsequently, the resist film 18 remaining on the surface of the cold cathode 16 is removed and then, the substrate is immersed in a buffer etching solution (a solution which is a mixture of one part of HF and six parts of $NH_4F$) thus to effect isotropic etching of $SiO_2$ film 8, whereby a concave portion 20 is formed under the edge portions of the cold cathode, and the anode and the tip end portions of both electrodes projecting over concave portion 20 (FIG. 5).

When a voltage is applied between the cold cathode 21 and anode 22 thus formed, a strong electric field of more than $10^7$ V/cm is generated and the field emission of electrons takes place from the tip end portion.

It is to be noted here that the combination of electrode material and electrically insulating material is not limited to that of $WSi_2$ and a material such as $SiO_2$, but W, Mo, $W_2C$, NbC, HfC which has a high melting point and low work function and difficult to be dissolved in the buffer etching solution can be used as an electrode material and a material such as glass sheet which is soluble in the buffer etching solution as an electrically insulating substrate material may be used.

Furthermore, although conventional photoresist material was used in the present embodiment, after depositing $SiO_2$ or $Si_3N_4$ on the surface of a cold cathode material, the material obtained by photoetching these materials may be used as a resist film. When these materials are used as resist film, it becomes possible to make the side etching amount to be 1 μm or more.

When an electron source constituted so that a plurality of cold cathodes are confronted with an anode is made using the manufacturing method of the present embodiment, even with scatterings in the performance of respective cold cathodes, such scatterings are averaged on the whole, resulting in a stable electron source.

EFFECT OF THE INVENTION

According to the present invention, even without using a microfabrication technique of submicron order such as FIB, it becomes possible to form uniformly and reproducibly a cold cathode tip end portion having a radius of curvature of less than 0.1 μm, whereby an electron source capable of generating field emission of electrons at a low voltage of less than 100 V can be obtained. By using this electron source, it becomes possible to manufacture at a low cost a high speed switching element and an image display device.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A planar type cold cathode-anode structure for generating electron field emission which includes a planar cold cathode having planar surfaces spaced in the direction of the thickness thereof, and an anode, said cathode and said anode being formed on a substrate of an electrically insulating material so as to confront each other, said substrate having a concavity therein, said cold cathode having substantially triangular convex portions projecting over the edge of said concavity toward said anode, each convex portion of said cathode having two tip ends defined by said planar surfaces and ends of a tip edge extending between said planar surfaces at the apex of the triangular convex portion, at least one tip end of each said convex portion having a radius of curvature of no more than 0.1 μm, and said one tip end of each said convex portion protruding toward said anode farther than the other tip end of each said convex portion.

2. A planar type cold cathode-anode structure as claimed in claim 1 in which said one tip end is the tip end of each said convex portion on the planar surface of the convex portion which is adjacent to said concavity.

* * * * *